United States Patent [19]

Murata et al.

[11] Patent Number: 4,839,252

[45] Date of Patent: Jun. 13, 1989

[54] ELECTROPHOTOGRAPHIC PHOTORECEPTOR

[75] Inventors: Tadaichi Murata; Tsuneo Isomura; Kenichi Fujimori; Fuminori Tsuruta; Kazuhito Dohi; Masahiro Horigome; Yoshitarou Nakayama; Sachio Oomori, all of Kofu, Japan

[73] Assignees: Shindengen Electric Manufacturing Co., Ltd, Tokyo; Yamanashi Electronics Co. Ltd., Yamanashi, both of Japan

[21] Appl. No.: 160,930

[22] Filed: Feb. 26, 1988

[30] Foreign Application Priority Data

Mar. 13, 1987 [JP] Japan ..... 62-58414

[51] Int. Cl.[4] ..... G03G 5/06

[52] U.S. Cl. ..... 430/59; 430/74; 546/315; 546/330

[58] Field of Search ..... 430/73, 74, 59; 546/315

[56] References Cited

U.S. PATENT DOCUMENTS 4,751,163 6/1988 Hagiwara et al. ..... 546/315 X

FOREIGN PATENT DOCUMENTS 55-42380 10/1980 Japan .
61-7840 1/1986 Japan .
61-23154 1/1986 Japan .
62-30255 2/1987 Japan .

*Primary Examiner*—J. David Welsh

*Attorney, Agent, or Firm*—Stevens, Davis, Miller & Mosher

[57] ABSTRACT

An electrophotographic photoreceptor having a photosensitive layer containing a butadiene compound represented by general formula wherein $A_1$ to $A_4$ are alkyl group, and a hydrazone compound represented by general formula wherein $B_1$ and $B_2$ are alkyl, phenyl, benzyl or methoxyphenyl groups, $R_1$ is hydrogen, alkyl, alkoxy or benzyloxy groups and $R_2$ is alkyl, phenyl or benzyl groups. The photoreceptor can suppress the photo-deterioration due to cyclic operation and is useful in the field of copying printers.

3 Claims, 1 Drawing Sheet

ELECTROPHOTOGRAPHIC PHOTORECEPTOR

FIELD OF THE INVENTION AND RELATED ART STATEMENT

1. Field of the Invention

The present invention relates to a electrophotographic photoreceptor, and, more particularly, to a photoreceptor using an organic photoconductive material.

2. Related Art

Generally, as photoconductive materials for electrophotographic photoreceptors, inorganic materials such as selenium (Se), cadmium sulfide (CdS), zinc oxide (ZnO) and amorphous silicons (a-Si) are used. Photoreceptors using such inorganic materials are operated such that they are charged, for example, with charging brush in the dark, subjected to imagewise exposure to selectively neutralize the charges only on the illuminated regions, thereby forming the latent electrostatic image, and then developed with developer to make the latent image visible, thereby forming the image.

Fundamental characteristics required for such electrophotographic photoreceptors are: (1) being capable of being charged to an adequate potential in the dark and (2) having a function of neutralizing the surface charge by light illumination. With respect to these characteristics, however, the aforementioned inorganic materials have both advantages and disadvantages. For instance, Se satisfies well the characteristics (1) and (2) above but it lacks flexibility and is thus difficult to convert into films. It is also sensitive to heat and mechanical shocks and thus needs cautions in handling. The amorphous silicons (a-Si) has disadvantage that it requires severe manufacturing conditions, which leads to a high manufacturing cost.

Recently, however, various photoreceptors which use organic materials eliminating the above-mentioned disadvantages have been proposed and also put to practical use. For example, Japanese Patent KOKOKU (Post-Examination Publication) No. 42380/80 and Japanese Patent KOKAI (Laid-Open) Nos. 7840/86 and 23154/86 disclose the photoreceptors having hydrazone compounds contained in a charge-generating layer or a charge transfer layer, in particular. Also, Japanese Patent KOKAI (Laid-Open) No. 30255/87 discloses a photoconductive material consisting essentially consisting of styryl compounds.

However, the organic materials containing the hydrazone compounds are excellent in electrical characteristics but cannot solve the problem of photo-deterioration. On the other hand, the photoconductive materials consisting essentially of the styryl compounds are effective in inhibiting photo-deterioration but have some defects in electrical characteristics. There has also been proposed a combination of the both compounds, but it is not practical.

As explained above, adequate photoconductive materials which have the characteristics required for photoreceptors have not been obtained in the art.

OBJECT AND SUMMARY OF THE INVENTION

It is an object of the present invention to provide an electrophotographic photoreceptor satisfying the above-mentioned characteristics by combining organic photoconductive materials and, in particular, by improving photo-deterioration and reduction of surface potential due to cyclic operation.

The electrographic photoreceptor according to the present invention is characterized in that said photoreceptor has a photosensitive layer containing a butadiene compound represented by the following general formula [I] and a hydrazone compound represented by the following formula [II]:

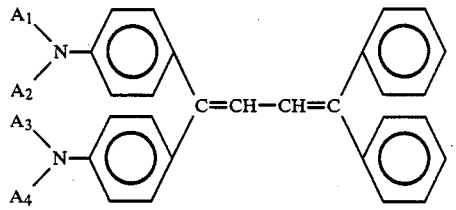

[I]

wherein $A_1$–$A_4$, which may be the same or different, are each an alkyl group,

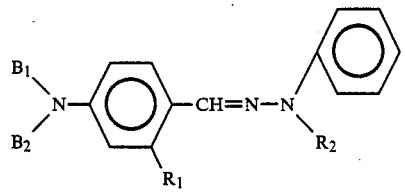

[II]

wherein $B_1$ and $B_2$, which may be the same or different, are each an alkyl group, a benzyl group or a methoxyphenyl group; $R_1$ is a hydrogen, an alkyl group or an O—R in which R is a linear or branched chain alkyl group of 5 to 10 carbon atoms, an alkenyl group, an alkadienyl group or an aralkyl group of 7 to 10 carbon atoms; and $R_2$ is an alkyl group, a phenyl group, a p-methoxy benzyl group, an ethoxyphenyl group, a benzyl group, a methoxyphenyl group, a tolyl group and a naphthyl group.

It has been confirmed that by the above-mentioned constitution the resulting photoreceptor using the organic material has the excellent characteristics in which the drawbacks for photoconductive materials inherent to both the butadiene compound and the hydrazone compound are compensated.

DETAILED DESCRIPTION OF THE PREFERRED EMBODIMENT

Preferred specific examples of the butadiene compounds of general formula [I] are those of general formula [I] in which every one of $A_1$–$A_4$ is a methyl group or an ethyl group, that is to say, (1)

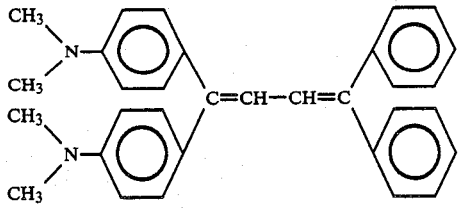

1,1-bis(p-dimethylaminophenyl)-4,4-diphenyl-1,3-butadiene and (2)

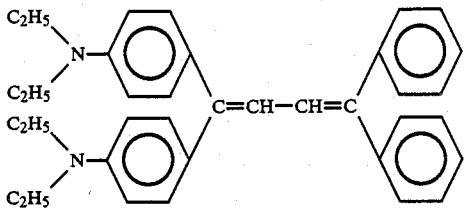

1,1-bis(p-diphenylaminophenyl)-4,4-diphenyl-1,3-butadiene.

Preferred specific examples of the hydrazone compounds of general formula [II] are those of general formula [II] in which both $B_1$ and $B_2$ are methyl groups, ethyl groups, benzyl groups or phenyl groups, or $B_1$ is a benzyl group and $B_2$ is a methoxyphenyl group, $R_1$ is hydrogen, a methyl group, a methoxy group or a benzyloxy group and $R_2$ is a methyl group, a phenyl group or a benzyl group, that is to say, (3)

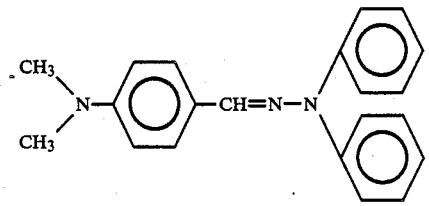

p-dimethylaminobenzaldehyde-(diphenylhydrazone), (4)

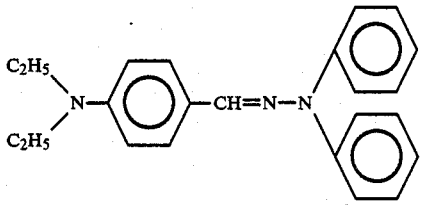

p-diethylaminobenzaldehyde-(diphenylhydrazone), (5)

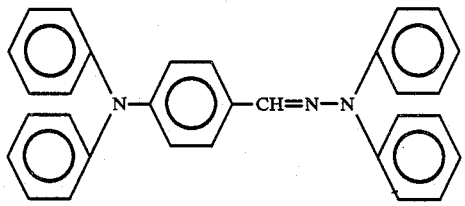

p-diphenylaminobenzaldehyde-(diphenylhydrazone), (6)

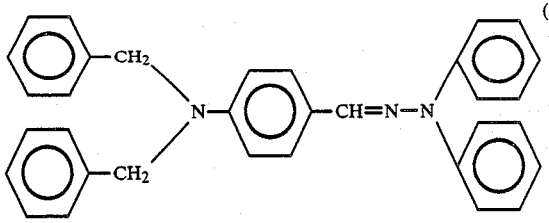

p-benzylaminobenzaldehyde-(diphenylhydrazone), (7)

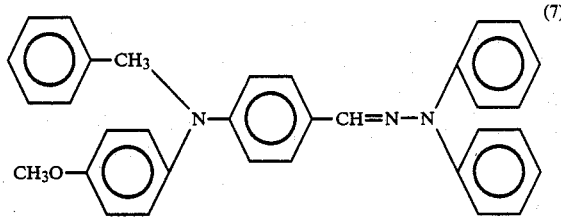

p-(benzyl-methoxyphenyl)aminobenzaldehyde-(diphenylhydrazone), (8)

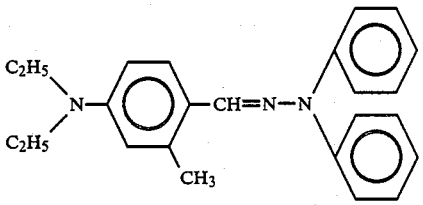

o-methyl-p-diethylaminobenzaldehyde-(diphenylhydrazone), (9)

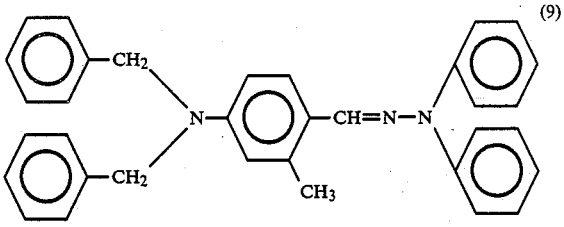

o-methyl-p-dibenzylaminobenzaldehyde-(diphenylhydrazone), (10)

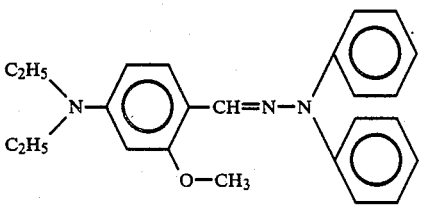

o-methoxy-p-diethylaminobenzaldehyde-(diphenylhydrazone), (11)

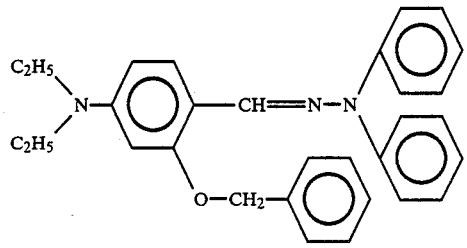

o-benzyloxy-p-diethylaminobenzaldehyde-(diphenylhydrazone), (12)

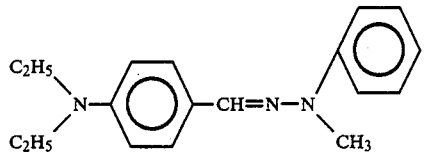

p-diethylaminobenzaldehyde-(methyl-phenylhydrazone), (13)

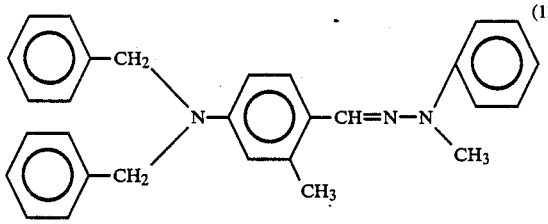

o-methyl-p-dibenzylaminobenzaldehyde-(methylphenylhydrazone), and (14)

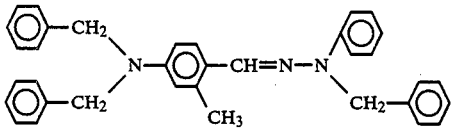

o-methyl-p-dibenzylaminobenzaldehyde-(benzylphenylhydrazone.

These butadiene compounds and hydrazone compounds have been known before the filing of the present patent application. For instance, the butadiene compounds can be prepared by the method described in the above-mentioned Japanese Patent KOKAI (Laid-Open) No. 30255/87, and the hydrazone compounds, by the method described in the above-mentioned Japanese Patent KOKAI (Laid-Open) Nos. 7840/86 and 23154/86.

However, the hydrazone compounds that are not represented by general formula [II], for example, the hydrazone compound represented by the following formula:

(15)

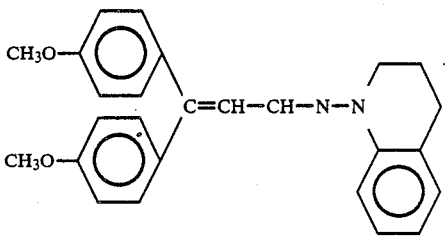

N[3,3 bis-4'-methoxyphenyl-2-propenylideneamino]tetrahydroquinone, when used alone, is comparably effective to the above-mentioned compounds (3) to (14) in that it is subjected to the photo-deterioration, that is, it increases a residual potential during repeated use after illumination. Also, unlike the above-mentioned compounds (3) to (14), such compounds as represented by formula (15), when mixed with only a small amount of butadiene compounds (1), (2), etc. represented by general formula [1], produces a high residual potential, and it may thus be said that such compound is not suitable for practical use.

Figure 1:
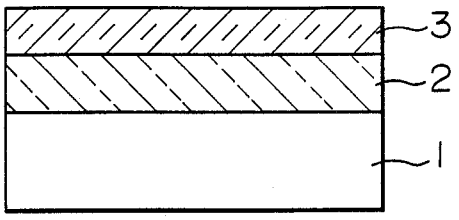
FIGS. 1 and 2 each is a sectional view of an electrophotographic photoreceptor according to the present invention.
Figure 2:
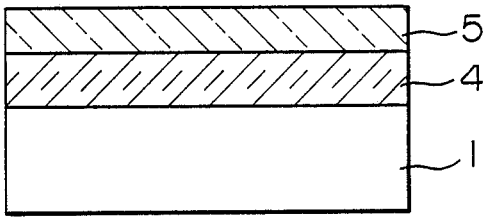

The electrographic photoreceptor according to the present invention may have the structures as shown in FIGS. 1 and 2. FIG. 1 shows a separately functioning double-layer structure of negatively charging mode, which comprises a support 1, a charge-generating layer 2 on the support 1, and a charge transfer layer 3 on top. FIG. 2 shows a double-layer structure of positive charging mode, which comprises a support 1 having a charge transfer layer 4 thereon and a charge-generating layer 5 on top.

The photoreceptor according to the present invention may, if desired, have an additional charge transfer layer on the top layer.

The photoreceptor according to the present invention may be manufactured by applying on a conductive support a coating solution obtained by dissolving a butadiene compound [1,1,4,4-tetraphenyl-1,3-butadiene compound] represented by the above-mentioned general formula [I] and a hydrazone compound represented by the above-mentioned general formula [II] together with a binder in a suitable solvent and drying the coating solution to form a photosensitive layer of, usually, 5 to 30 μm. The coating solution may optionally contain photoconductive materials which absorb light to generate charge, sensitizing dyes, electron absorbable materials and plasticizers.

In the case of the structure comprising the charge-generating layer 2 and the charge transfer layer 3 in FIG. 1, the above-mentioned coating solution is applied on the charge-generating layer 2 comprising the photoconductive material dispersed in the binder. In the case of the structure shown in FIG. 2, the charge-generating layer 5 is formed on the charge transfer layer 4 formed by applying the above-mentioned coating solution to the support 1. The amount added of a mixture of the butadiene compound and the hydrazone compound is in the range of from 20 to 200 parts by weight, and preferably from 30 to 150 parts by weight per 100 parts by weight of the binder. The ratio, in the mixture, of the butadiene compound to the hydrazone compound is such that the hydrazone compound is in the range of from 10 to 4,000 parts by weight, and preferably from 50 to 3,000 parts by weight per 100 parts by weight of the butadiene compound. For the charge-generating layer applied in the present invention may be used the known photoconductive materials alone or in combination, for example, the inorganic materials such as Se, Se-Te alloys, Se-As alloys, CdS and ZnO; phthalocyanines containing metals such as Cu, Al, In, Ti, Pb and V; and the organic materials such as metal-free phthalocyanines, chlorodiane, azo base pigments, blue pigments, bis-azo base pigments and cyanine base pigments, the electrical insulating binders which may be used alone or in combination include thermoplastics such as polyesters, polycarbonates, polyacrylates and polyamides, thermosetting resins such as epoxy, urethane and silicone resins, photocurable resins, poly-N-vinyl-carbazole. The solvents which can be used for the preparation of the coating solution include ethers such as tetrahydrofuran and dioxane; ketones such as methyl ethyl ketone and cyclohexanone; aromatic hydrocarbons such as toluene and xylene; and chlorinated hydrocarbons such as dichloroethane and chloroform. The conductive supports which can be used include aluminum and nickel which have been converted into sheets or drums; plastic films with the surfaces which have been vacuum-deposited or plated with metals such as aluminum, copper and nickel; and plastic materials mixed with conductive powders such as carbon and fabricated into the form of sheet or drum.

The present invention will be described in greater detail with reference to the following examples.

EXAMPLE 1

Titanyl phthalocyanine was heated at a degree of vacuum of $10^{-6}$ mmHg and vacuum-deposited on an aluminum drum in the thickness of 0.2 μm to form a charge-generating layer. A coating solution consisting of 100 parts by weight of polycarbonate Z manufacture by Mitsubishi Gas Kagaku Company, 10 parts by weight of butadiene compound (2) of the aforementioned general formula [I], 1,1-bis(p-diethylaminophenyl)-4,4-diphenyl-1,3-butadiene, 90 parts by weight of hydrazone compound (3) of the aforementioned general formula [II], p-dimethylaminobenzaldehyde-(diphenylhydrazone), and 1,000 parts by weight of dichloroethane, was applied onto the charge-generating layer by a spraying or dipping method to form on 18 μm thick charge transfer layer and dried at 80° C. for one hour in the air to prepare a photoreceptor of this example.

EXAMPLE 2

A photoreceptor of this example was prepared in the same manner as in Example 1 but using hydrazone compound (9), o-methyl-p-dibenzylaminobenzaldehyde(diphenylhydrazone), in place of hydrazone compound (3).

EXAMPLE 3

A photoreceptor of this example was prepared the same manner as in Example 1 but using hydrazone compound (11), o-benzyloxy-p-diethylaminobenzaldehyde(-diphenylhydrazone), in place of hydrazone compound (3).

For comparison with the examples of the present invention two comparative photoreceptors each having a layer conaining a hydrazone compound alone or a butadiene compound alone on the same charge-generating layer as that of the photoreceptor of Example 1 were prepared.

COMPARATIVE EXAMPLE 1

A photoreceptor of this comparative example was prepared by applying on the charge-generating layer a coating mixture consisting of 100 parts by weight of polycarbonate Z, 100 parts by weight of butadiene compound (2) and 1,000 parts by weight of dichloroethane.

COMPARATIVE EXAMPLE 2

A photoreceptor was prepared in the same manner as in Comparative Example 1 but using hydrazone compound (3) in place of butadiene compound (2).

COMPARATIVE EXAMPLE 3

A photoreceptor was prepared in the same manner as in Comparative Example 1 but using hydrazone compound (9) in place of butadiene compound (9).

COMPARATIVE EXAMPLE 4

A photoreceptor was prepared in the same manner as in Comparative Example 3 but using hydrazone compound (11) in place of hydrazone compound (9).

COMPARATIVE EXAMPLE 5

A photoreceptor was prepared in the same manner as in Comparative Example 3 but using hydrazone compound (15) in place of hydrazone compound (9).

COMPARATIVE EXAMPLE 6

A photoreceptor was prepared in the same manner in Example 1 but using hydrazone compound (15) in place of hydrazone compound (3).

The drum photoreceptors prepared in the above examples and comparative examples were negatively charged with a discharge of −5 KV to measure their electrophotographic characteristics. The results are given in Table 1 below.

TABLE 1

| | (1) Vo | (2) Efo | (3) DDR1 | (4) Vo1 | (5) VR1 | (6) Vo2 | (7) VR2 | (8) DDR2 |
|---|---|---|---|---|---|---|---|---|
| Example 1 | 700 V | 0.6 (μJ/cm²) | 0.9 | 700 V | 40 V | 690 V | 60 V | 0.8 |
| Example 2 | 700 V | 0.5 (μJ/cm²) | 0.9 | 700 V | 40 V | 690 V | 65 V | 0.85 |
| Example 3 | 650 V | 0.6 (μJ/cm²) | 0.9 | 700 V | 50 V | 680 V | 70 V | 0.85 |
| Compar. Ex. 1 | 600 V | 0.4 (μJ/cm²) | 0.85 | 700 V | 20 V | 600 V | 120 V | 0.7 |
| Compar. Ex. 2 | 700 V | 0.7 (μJ/cm²) | 0.9 | 700 V | 80 V | 730 V | 130 V | 0.8 |
| Compar. Ex. 3 | 700 V | 0.6 (μJ/cm²) | 0.9 | 700 V | 70 V | 720 V | 120 V | 0.85 |
| Compar. Ex. 4 | 650 V | 0.7 (μJ/cm²) | 0.9 | 700 V | 90 V | 740 V | 140 V | 0.85 |
| Compar. Ex. 5 | 750 | 0.4 | 0.85 | 700 V | 50 V | 710 V | 100 V | 0.75 |

TABLE 1-continued

| | (1) Vo | (2) Efo | (3) DDR1 | (4) Vo1 | (5) VR1 | (6) Vo2 | (7) VR2 | (8) DDR2 |
|---|---|---|---|---|---|---|---|---|
| | | ($\mu J/cm^2$) | | | | | | |
| Compar. Ex. 6 | 700 | 8 ($\mu J/cm^2$) | 0.88 | 700 V | 550 | 770 V | 620 V | 0.82 |

(1) Surface charge (−5 kV)
(2) Half-valve exposure (at 650 V and 780 nm)
(3) Dark decay ratio (initial)
(4) Dark decay ratio (after 200 cycles)
(5) Initial charge potential
(6) Charge potential after 200 cycles
(7) Initial residual potential
(8) Residual potential after 200 cycles As is clear from table 1 above the photoreceptor of Comparative Example 1 has the disadvantage that during cyclic operation the variation in the dark decay ratio (DDR2) increases and the fall of the surface potential becomes large. Also, with the photoreceptors of Comparative Examples 2 to 4 the increase in the residual potential due to cyclic operation is large, although the variation in the dark decay ratio is small. These results indicate that using the butadiene compounds or the hydrazone compounds alone provides no photoreceptor suitable for practical use. On the other hand, by using both the compounds in combination the photoreceptors obtained have particularly preferable characteristics for electrophoto-graphic application in that the variation in the dark decay ratio and during cyclic operation the fall of the surface potential is small and no increase in the residual potential is observed.

As to hydrazone compounds excepting those in the present invention, as is apparent from table 1 the photoreceptor of Comparative Example 5 has a large variation in the dark decay ratio (DDR2) due to cyclic operation and the photoreceptor of Comparative Example 6 has a significantly reduced sensitivity and a very high residual potential; therefore, they are far from being practical.

Furthermore, the photoreceptors prepared by using 90 parts by weight of hydrazone compound (15) and 1 to 9 parts by weight of butadiene compound (2) showed the characteristics approaching those of the photoreceptor of Comparative Example 6, with the increasing amount of butadiene compound (2).

The photoreceptor drum of the laminate type having the structure shown in FIG. 2 as in Example 1 was prepared and its electrophotographic characteristics were measured with the good results that, when positively charged with a discharge of +5.5 kV, the photoreceptor had a half-value exposure of 0.7 $\mu J/cm^2$ (at 780 nm) and the surface potential of 600 V, which are fit for practical use.

When the photoreceptor drum of the present invention was applied to a semiconductor laser printer and was subjected to the life-test with 10,000 sheets (A 4 size), the result was good in that no change in the density of the black letters was observed.

Also, when the photoreceptor drum was used repeatedly in the environments of low temperature (10° C.) and of high temperature and humidity (45° C., 85% RH), it showed very good characteristics that the change of density and the occurrence of fog were not observed.

As described above, according to the present invention the advantages of the photoreceptors using organic materials can efficiently be used and the practically useful photoreceptors can be provided.

What is claimed is:

1. An electrophotographic photoreceptor comprising a support having thereon a photosensitive layer, in which said photosensitive layer contains a butadiene compound represented by general formula

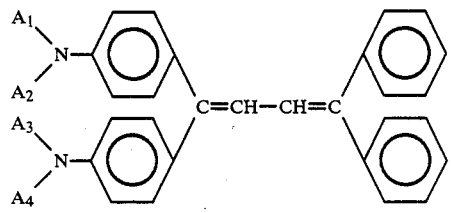

wherein $A_1$–$A_4$, which may be the same or different, are each an alkyl group, and a hydrazone compound represented by general formula

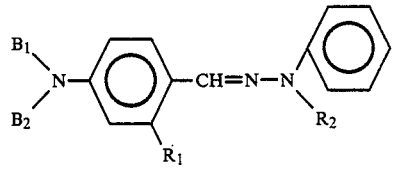

wherein $B_1$ and $B_2$, which may be the same or different, are each an alkyl group, a benzyl group or a methoxyphenyl group; $R_1$ is a hydrogen, an alkyl group or an O—R in which R is a linear or branched chain alkyl groups of 5 to 10 carbon atoms, an alkenyl group, an alkadienyl group or an aralkyl group of 7 to 10 carbon atoms; and $R_2$ is an alkyl group, a phenyl group, a p-methoxy benzyl group, an ethoxyphenyl group, a benzyl group, a methoxyphenyl group, a tolyl group and a naphthyl group.

2. The electrophotographic photoreceptor according to claim 1, wherein the butadiene compound is 1,1-bis(p-diethylaminophenyl)-4,4-diphenyl-1,3-butadiene.

3. The electrophotographic photoreceptor according to claim 1, wherein the hydrazone compound is selected from a group consisting of p-dimethylaminobenzaldehyde-(diphenylhydrazone), o-methyl-dibenzylaminobenzaldehyde-(diphenylhydrazone) and o-benzyloxy-p-diethylaminobenzaldehyde-(diphenylhydrazone).

* * * * *